US007828236B2

(12) United States Patent
Booth et al.

(10) Patent No.: US 7,828,236 B2
(45) Date of Patent: Nov. 9, 2010

(54) GRINDING MILL WITH AIR RECIRCULATION

(75) Inventors: Rodney I. Booth, 891 Barrenjoey Road, Palm Beach, New South Wales (AU) 2108; Mark L. Bason, Avalon (AU); Steven J. Neil, Turramurra (AU)

(73) Assignee: Rodney I. Booth, Palm Beach, New South Wales (AU)

( * ) Notice: Subject to any disclaimer, the term of this patent is extended or adjusted under 35 U.S.C. 154(b) by 943 days.

(21) Appl. No.: 11/600,385

(22) Filed: Nov. 16, 2006

(65) Prior Publication Data

US 2007/0108321 A1 May 17, 2007

Related U.S. Application Data

(60) Provisional application No. 60/737,460, filed on Nov. 16, 2005.

(51) Int. Cl.
*B02C 23/08* (2006.01)

(52) U.S. Cl. ..... 241/79.1; 241/97

(58) Field of Classification Search ..... 241/19, 241/24.1, 24.26, 79, 12, 79.1, 100, 86.1
See application file for complete search history.

(56) References Cited

U.S. PATENT DOCUMENTS

| | | | | |
|---|---|---|---|---|
| 4,213,571 | A * | 7/1980 | Deardorff et al. | 241/48 |
| 4,586,658 | A | 5/1986 | Eisenegger | |
| 5,660,339 | A | 8/1997 | Scott et al. | |
| 6,394,371 | B1 * | 5/2002 | Ribardi | 241/5 |
| 6,543,709 | B2 * | 4/2003 | Huang et al. | 241/19 |
| 6,713,112 | B1 * | 3/2004 | Lucas | 426/524 |
| 2003/0111568 | A1 * | 6/2003 | Coert et al. | 241/79.1 |
| 2004/0227023 | A1 * | 11/2004 | Hisamitsu | 241/74 |

* cited by examiner

*Primary Examiner*—Dana Ross
*Assistant Examiner*—Matthew G Katcoff
(74) *Attorney, Agent, or Firm*—Shewchuk IP Services, LLC; Jeffrey D. Shewchuk

(57) ABSTRACT

A grinding mill grinds grains or similar foodstuffs, while the concept of the invention could also be applied to other feed materials. The grain is fed at a controlled rate to an impeller chamber, ground by the impeller until a small enough size to fit through a sieve, and separated into a sample cyclone stream and a bulk or waste cyclone stream. Each cyclone includes a central air return duct which channels air back to the grain feeder chamber and then into the impeller chamber. By having the air from grinding recirculated back to the grinder after separation, the grain grinding process is cleaner and results in less moisture loss.

18 Claims, 5 Drawing Sheets

GRINDING MILL WITH AIR RECIRCULATION

CROSS-REFERENCE TO RELATED APPLICATION(S)

This application claims priority from provisional application No. 60/737,460, filed Nov. 16, 2005.

FIELD OF THE INVENTION

The present invention relates to the field of analysis of grain and similar foodstuffs, and particularly to mills for grinding such grain or foodstuffs prior to analysis. The present invention further relates to devices which act on a work material in an ongoing process which creates dust or moisture-loss, and to air handling in dust-creating or moisture-creating work material processing.

BACKGROUND OF THE INVENTION

Grain has been ground to make flour for ages. Early grinders used water, wind or horse power to turn one milling stone against another. Commonly ground grains include wheat, barley and rye, but corn, rice, beans and numerous other foodstuffs can be similarly ground.

More recent grinders use electrical power to turn a grinder in a higher speed process. In particular, electrical grinders have been used to grind grain for testing. One particular prior art grain testing mill, commercially available as a PERTEN 3100 mill, grinds grain using a high speed hammer type impeller in a screened (0.8 mm openings) chamber. The impeller is driven at about 16,800 rpm, and grinds about a 300 g sample in about 30-50 seconds. The grinding process utilizes the air stream created by the impeller to move the grain material about during grinding and to carry the flour away from the grinding chamber to a filter bag. If the mills grind the grain in a sufficiently fine, relatively homogeneous particle size, the ground particles can be used for sprout damage testing, viscosity analysis, toxin testing, pesticide testing, genetically modified organism (GMO) testing, falling number (FN) testing, Glutomatic/Gluten Index testing, near infrared (NIR) testing, stirring number (SN) testing and other tests. These tests can be performed on grain in grain receival, storage and export silos, elevators, terminals and grain laboratories.

When grain is ground at high speed, it creates not only the particles which make up the flour, but also smaller particles which remain airborne as dust even after the air stream from the impeller loses speed. Generally, to avoid the release of dust into the room where people are breathing and to avoid the mess created when the dust settles, the air stream from an impeller grinder is filtered such as through a filter bag or a separate filter prior to release to ambient. While the filtration process may effectively remove dust from the air, the grain dust particles often build up on the filter. The filter should be regularly cleaned or changed, resulting in additional costs of maintaining the grinding mill. If the filter is not regularly cleaned or changed, grain dust buildup on the filter can restrict airflow and adversely affect grinding mill operation. A fast grinding process which could avoid the creation and build-up of dust, and which could avoid the expense and hassle of filter changes, would be beneficial.

The grinding process also generally releases moisture (water molecules) and other smaller-than-dust particles into the air. The PERTEN 3100 mill, for example, typically dries the sample by approximately 0.5-1.0%, so the sample is not suitable for direct moisture testing, and moisture corrections need to be made for FN and SN testing. Depending upon the use of the ground material, it may be desired to quickly grind the material without releasing as much moisture or other smaller-than-dust particles.

Another problem with grinding mills, particularly when the resultant ground product is used for testing, is cleaning of the mill and carry-over of residual material from one milled sample to the next. Any mixing of samples decreases accuracy of the sample and the testing results. To the extent possible, a grinding mill should be easy to clean and should minimize carry over of residual material. Typical time required to sufficiently clean a PERTEN 3100 mill to eliminate carry-over between samples is 4½ minutes (includes cleaning of the grinding chamber, sample flow tube and cyclone).

SUMMARY OF THE INVENTION

A grinding mill in accordance with the present invention includes a powered grinder for reducing feed material into particles, with the powered grinder also creating dust. The particles and dust created are carried away in an air stream. At least one separator receives the particle laden air stream. In the separator(s) larger particles are separated from the air stream through a particle separation outlet while the air stream continues through a different air stream outlet. A return duct then returns air from the air stream outlet from the separator back to the grinder, so the air is recirculated in the grinding operation. In another aspect, the particle laden air stream is split into two or more air streams each with their own separator, effectively sampling from the ground material.

While the above-identified disclosure and drawing figures set one forth preferred embodiment, numerous other embodiments of the present invention are also contemplated. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
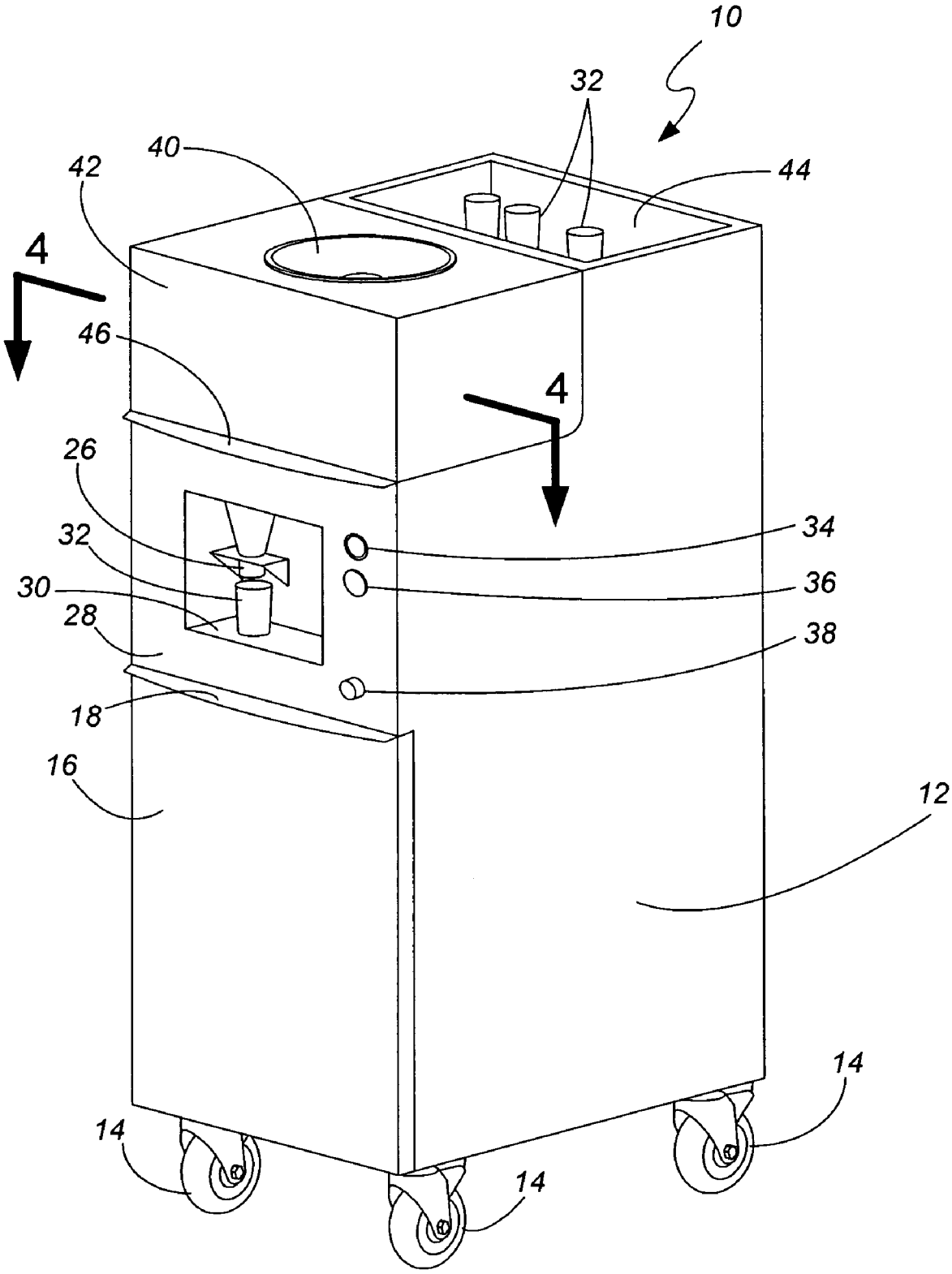
FIG. 1 is a perspective view of the exterior of a preferred grinding mill in accordance with the present invention.

As shown in FIG. 1, the preferred grinding mill of the present invention comes as a self-contained unit 10 including a chassis 12 portably mounted on lockable casters 14. The preferred housing 14 is about 1 meter tall, about 40 cm wide and 50 cm deep. At this size, the unit 10 is completely self contained and no bench space is required for the mill 10. While the present invention is preferably embodied as a portable unit 10, the concepts of the present invention can be equally applied to larger or permanently positioned units.

Figure 2:
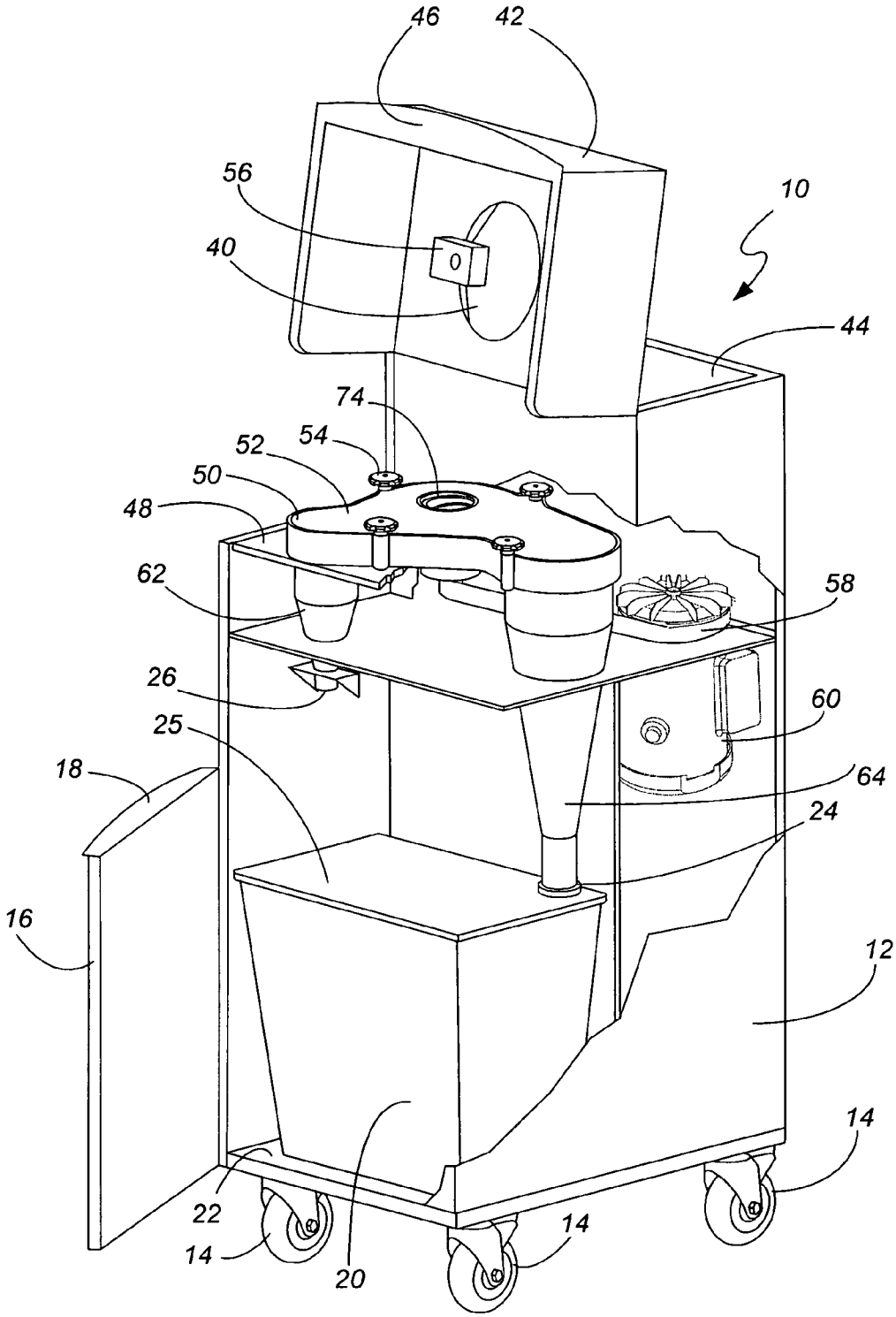
FIG. 2 is a perspective view of the grinding mill of FIG. 1, showing the hopper and waste doors open and removing certain chassis walls to better show the working mechanisms of the grinding mill.

In its bottom section, the preferred chassis 12 includes a front waste or bulk bin door 16 with a door handle 18, which door 16 is vertically hinged at the side for sideways opening as better shown in FIG. 2. Opening of the bin door 16 reveals a waste or bulk bin 20, which is supported on a bottom wall 22 of the unit 10 underneath the bulk outlet 24. The preferred bulk bin 20 is sized at about twenty liters, sufficient to collect the waste produced from grinding about forty samples. The preferred bulk bin 20 has an air tight cover 25 which seals the bulk bin 20 to the bulk outlet 24.

Figure 3:
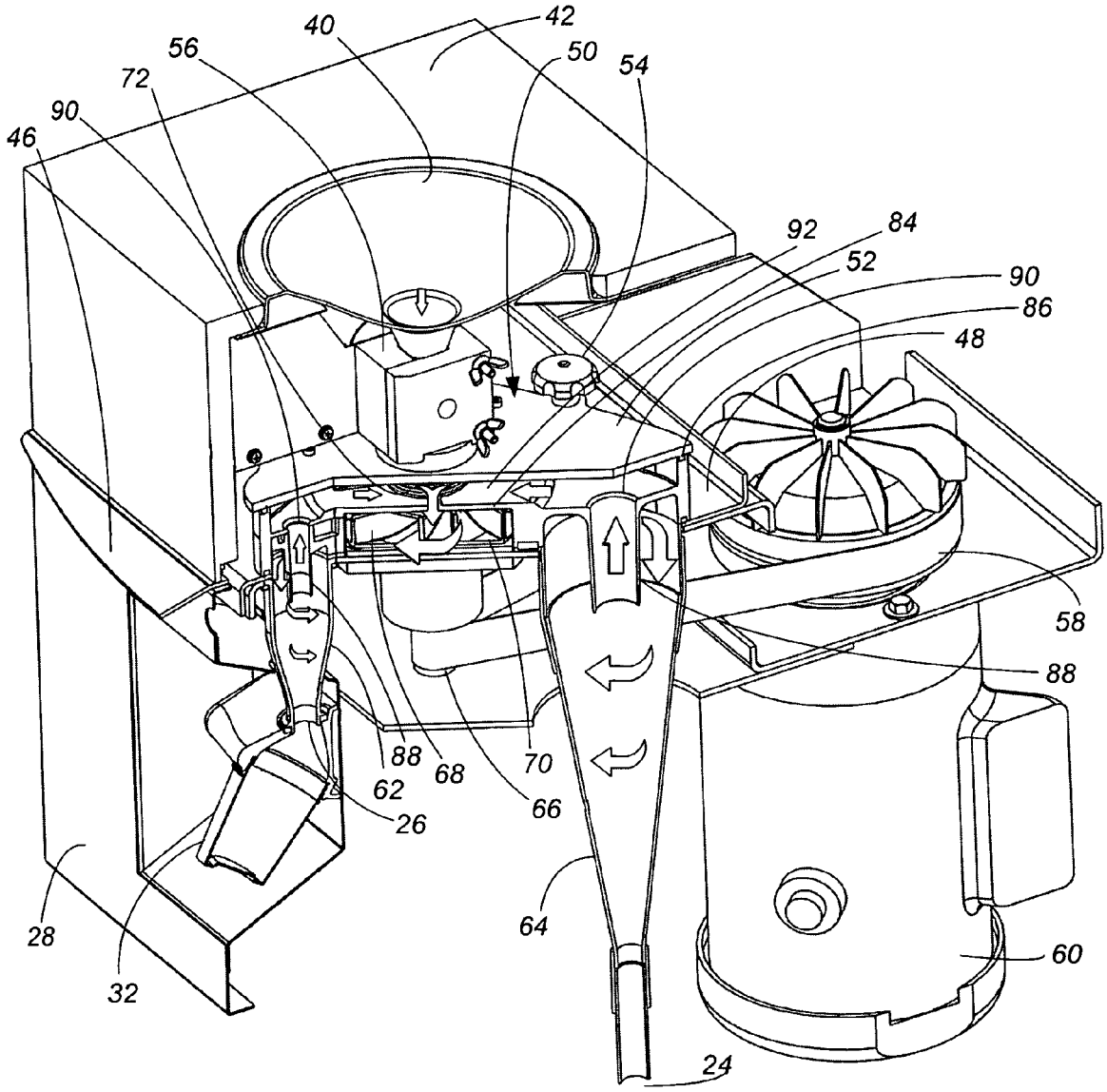
FIG. 3 is a perspective view of the working mechanisms of FIG. 2 during grinding, in partial cut-away to show the inside of various chambers in the grinding mill, with arrows to designate the direction of air movement.

A sample exit chute 26 is provided at a convenient height on the front face 28 of the chassis 12. The location of the preferred sample outlet 26 is recessed with a bottom surface 30 which can support a sample cup 32. The preferred sample cups 32 are convenient, removable containers which are low cost and permit multiple uses. The preferred sample chute 26 and sample cups 32 are clear to allow the operator to see the sample as it is collected. The preferred sample cups 32 attach to the exit chute 26 by a single turn thread, perhaps at an angle as shown in FIG. 3, which provides an air tight connection between the sample cups 32 and the sample outlet 26 during grinding.

Controls on the front face of the housing 14 include a power on button 34 and an emergency interrupt or power off button 36, as well as a reset button 38. In addition to these control buttons 34, 36, 38, a safety interlock for the milling chamber may be included for completely safe operation.

A feed hopper 40 is accessible at the top front of the unit 10, projecting conically downward in a front lid 42. When intended for testing purposes, the feed hopper 40 has a capacity which is sufficiently small to receive a testing sample, such as about 100 liters of feed material or less. The preferred feed hopper 40 for the portable unit 10 has a much smaller capacity, such as 0.6 to 1.0 liters of feed material, to receive a preferred sample size of 100 to 300 grams. The preferred feed hopper 40 extends from an about 18 cm top down to a 2 cm bottom opening over a depth of about 7 cm, or at an average opening angle of about 98°. Other shapes or sizes of feed hoppers may be used with other feed materials, particularly if the mill is used in a production operation (such as continuous grinding of grains, herbs, spices, other foodstuffs or minerals), of if the feed material is not gravitationally fed into the grinding chamber 70. For feed materials which are not particulate, a flexible feed hopper may form a better air seal against the feed material.

A recessed storage tray 44 is disposed to the rear of the front lid 42. The storage tray 44 convenient holds sample cups 32 and similar items.

The feed hopper 40 receives the feed material, which preferably is a grain such as wheat, barley or rye. However, the term "feed material" as used in the present application is not intended to be limited to particular grains, or even to grain or other foodstuffs, or even to particulate material. The present invention could have application to many other feed materials which involve grinding or similar processing producing dust as well as larger chunks or particles of material in the airbourne outlet stream. As examples, the present invention could be applied to mineral breaking or woodworking apparatus. The term "grinder" as used herein, refers to any power tool which cuts or breaks up the feed material into chips or smaller particles producing dust as a byproduct, including tools commonly used in the woodworking art such as sanders, saws, lathes, routers, etc. While the preferred embodiment grinds the entirety of the feed material, the present invention also has application on grinders that reshape a workpiece of feed material, leaving a substantial portion of the feed material intact.

A second handle 46 on the front of the unit 10 can be used to raise the front lid 42 as shown in FIG. 2. Raising of the front lid 42 reveals a stainless steel work surface 48 and a grinding and separation unit 50, shown with its top plate 52 secured down by four handle nuts 54. Underneath the front lid 42 at the outlet from the feed hopper 40, a motorized feeder wheel or similar metering unit 56 governs the outlet from the feed hopper 40, transferring the feed material (when the front lid 42 is closed) from the feed hopper 40 to the grinding and separation unit 50. The preferred metering unit 56 is an automated controlled-rate sample auger running at 50 rpm for ease of use and control of particle size. By having the feed material be particulate material, the metering unit 56 easily controls the rate of material introduction from the feed hopper 40.

Also, the metering unit 56, together with the feed material itself, provides a barrier on the top side of the grinding and separation unit 50. While the preferred metering unit 56 is intended for particulate material, a wide variety of other metering units could be used. One significant aspect of the feed hopper 40 and metering unit 56 together with the material itself is that they restrict ambient air from directly reaching the grinding and separation unit 50 through the feed material inlet. Thus, the grinding operation takes place in a substantially enclosed chamber 70.

The grinding and separation unit 50 is powered such as by a belt drive 58 from a motor 60. The preferred mill 10 automatically grinds 300 g of grain to comply with AACC sample preparation method for the Stirring Number test and the AACC sample preparation method for use with the PERTEN 3100 mill. The grinding and separation unit 50 uses an air stream to transfer ground material to a sample cyclone 62 and a bulk cyclone 64.

During use of the unit 10 for grinding grain, a representative sample of 250-300 g is obtained, typically using a truck sampling system e.g. hand or pneumatic spear. Commonly grain moisture and protein content are determined by NIR instrumentation at this stage. The operator places the feed material for grinding into the feed hopper 40. The operator presses the on button 34, and the feed material is fed into the grinding and separation unit 50 which grinds the sample. A majority of the sample is processed into the bulk bin 20, but a representative proportion of the sample is ground and dispensed into the sample cup 32. The sample is collected continuously through the grinding process so that all parts of the grind stream are sampled.

After the sample is obtained, sprout damage can then be assessed using a NEWPORT SCIENTIFIC Robot Dispenser and RVA-STARCHMASTER. A scoop of sample is added to an RVA canister and placed on the Robot Dispenser, which weighs it and dispenses the correct amount of water. The operator then places a paddle in the canister and inserts the assembly into the RVA-STARCHMASTER, which determines grain soundness in a three minute test. The entire operation (including sampling and NIT testing) takes approximately 6-7 minutes, half that required for testing with a PERTEN 3100 mill and Falling Number machine. Automation of the cleaning, sub-sampling and weighing substantially improve the reliability of the test result.

Figure 4:
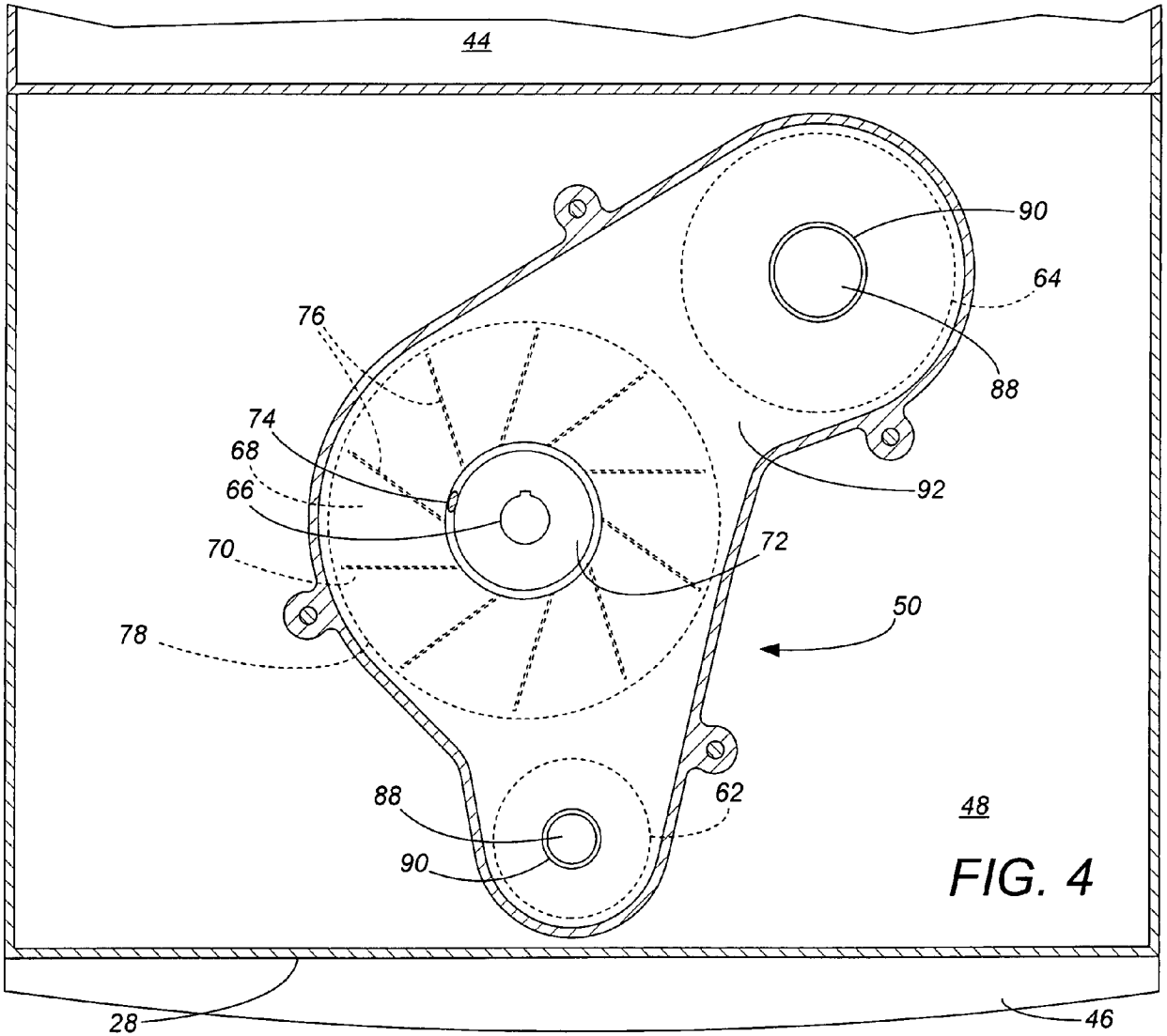
FIG. 4 is a cross-sectional plan view showing the plan layout of the grinding and separation unit relative to the cyclone separators, taken along lines 4-4 from FIG. 1.
Figure 5:
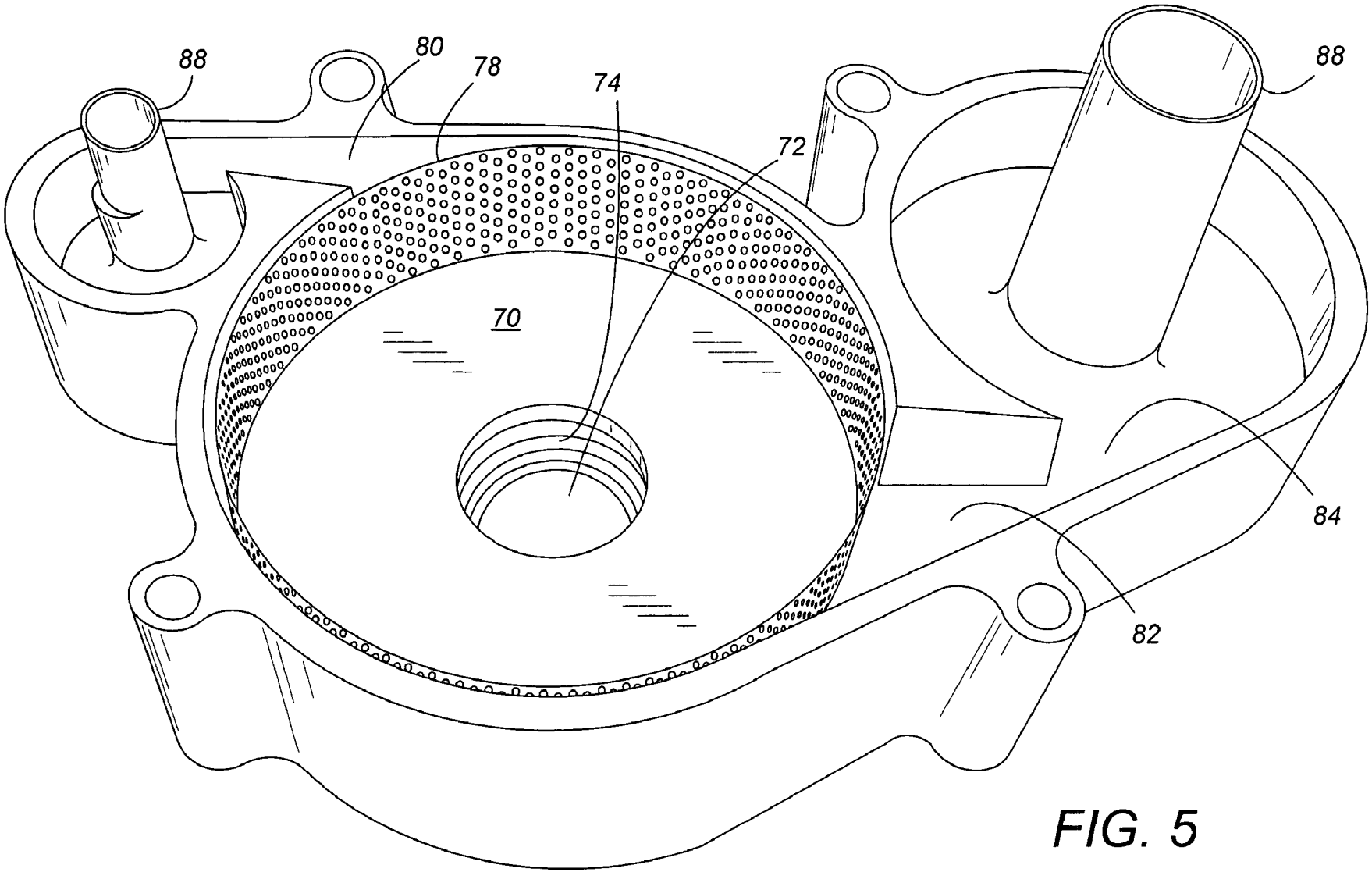
FIG. 5 is a perspective view of the chamber tops after being removed from the grinding mill work surface and flipped over.

The inner workings of the mill 10 are better shown in FIGS. 3-5. The electric motor 60 drives an impeller shaft 66 via the belt 58. The preferred embodiment 10 uses a powerful 2 hp motor 60 for rapid grinding, trouble free operation and long life. A fan shaped impeller 68, shown in plan view in FIG. 4, is mounted on the shaft 66 and rotates within a grinding chamber 70. The feed material is fed by the metering unit 56 from the feed hopper 40 downward through an air recirculation chamber 72 and into the grinding chamber 70. The air recirculation chamber 72 may include a spring 74 or other form of open wall so the feed material passes directly to the grinding chamber 70 adding air from the recirculation chamber 72.

The preferred impeller 68 has an about 12 cm diameter and rotates at about 16,000 rpm for grinding of the preferred grain feed materials. The impeller blades 76 are each about 2 cm in height and about 4 to 5 cm long, with the preferred impeller 68 being cast out of 316 stainless steel. At the same time as the impeller 68 grinds the feed material, the impeller 68 generates an air stream which carries the ground material. While the present invention works elegantly for grinders such as the preferred impeller 68 which create their own air stream, the air stream carrying the ground, particulate material and dust could be assisted or separately generated, such as with a fan (not shown).

As best shown from the bottom side view of FIG. 5, the outer periphery of the grinding chamber 70 is provided by a cylindrical punched metal screen or sieve 78. The sieve 78 acts to retain material in the grinding chamber 70 until it has been reduced in size sufficient to pass through the sieve 78. The preferred sieve 78 has a height of about 3 cm and a diameter of about 13 cm around the preferred impeller 68. The preferred sieve 78 has openings of 1.0 mm in diameter, but this size can be chosen as desired for the size of particles desired to be output from the grinding operation. Since the impeller 68 rotates at high speed, the grinding action is though impact of the material with the sides of the grinding chamber 70 and impact of the material with other pieces of material bouncing around within the grinding chamber 70. The preferred sieve 78 is formed of 0.8 mm thick 304 stainless steel, for long life and strength, corrosion resistance, and ease of cleaning.

The grinding chamber 70 is provided with at least one, and preferably two or more exits 80, 82 through the sieve 78. In the preferred embodiment of the invention, two exits 80, 82 are provided, each of different dimensions. The smaller exit 80 is used to collect a smaller fraction of the ground material, and the larger exit 82 collects the remainder. Commonly, the smaller fraction will be used for analysis, the remainder going to bulk or waste. In the preferred embodiment, the smaller exit 80 receives about 1 to 15% of the total and represents the testing sample. The larger exit 82 receives about 85 to 99% of the total and represents bulk or waste material. In the most preferred embodiment, about 5% of the ground material goes to the sample and about 95% of the ground material goes to bulk or waste. By selecting the relative size of the exits 80, 82, different ratios of material may be transmitted into each exit 80, 82. An advantage of this method is that each stream is representative of the total ground material. Another embodiment of the invention (not here pictured) utilizes six or eight exits, each feeding a separate separation cyclone and collection vessel.

Material passing through each exit 80, 82 is carried in the air stream created by the impeller 68 to a cyclone separator 62, 64. A smaller cyclone separator 62 receives the smaller sample stream, and a larger cyclone separator 64 receives the larger bulk or waste stream. The cyclone separators 62, 64 are preferably formed of a hard, smooth plastic such as urethane, to help prevent dust or particle build-up on the side walls. The sample cyclone separator 62 in particular can be formed of a transparent material, so the swirling airstream can be viewed at the sample outlet at the front of the mill 10. The intermediate wall 84 (ceiling of the grinding chamber 70, floor of the recirculation chamber 72, shown in FIG. 5) can also be formed of a similar, hard smooth material. One or more gaskets 86 can be used connecting the various walls of the air return plenum 92 and grinding chamber 70, such that the grinder, separator 62, 64 and return duct are generally air tight relative to the particle separation outlet.

In each cyclonic separator 62, 64, the air stream containing the ground material is directed spirally downward, possibly through using a cylindrical top section of the cyclonic separator with a downward spiral guide. As the air spirals around in the cyclone separator 62, 64, the airbourne particles, being more dense and having more momentum than the air, are thrown outward under their own momentum into the sidewall of the cyclone separator 62, 64. As each particle contacts the sidewall of the cyclone separator 62, 64, the particle slows down, causing the particle to fall out of the spiraling airstream downward to the ground material outlet 24, 26. The ground material is accordingly separated from the air stream, falling downward under the assistance of gravity into the collection vessel(s) 32 or bulk bin 20. Having the collection vessel(s) 32 and bulk bin 20 sealed to the ground material outlets 24, 26 further ensures that no dust escapes or is generated when the ground material positions itself in the collection vessel(s) 32 or bulk bin 20.

The preferred sample cyclone 62 has a top diameter of about 38 mm and then narrows conically to a bottom diameter of about 16 mm, extending over a height of about 11 cm. The preferred bulk cyclone 64 has a top diameter of about 75 mm and then narrows conically to a bottom diameter of about 20 mm, extending over a height of about 30 cm. By narrowing toward its bottom, the cyclone 62, 64 causes a tighter swirling of air, such that as the airstream loses energy (and speed) due to friction, it simultaneously increases its angular velocity due to the tighter spinning.

After the airstream has had all particles of significant size cyclone-removed, the airstream itself reaches an ambient pressure at a bottom extent of its travel and then spirals upward in the middle of the cyclone separator 62, 64. Essentially no air if the sample cup 32 and bulk bin 20 are sealed to the outlets 24, 26 (or, if unsealed, the same minimal amount of air that was entrained in the feed material due to its particulate nature in the hopper 40, plus any air expansion due to heating) exits from the bottom of each cyclone 62, 64. The largely particulate-free air, including only dust-sized and smaller particles and humidity, returns up the center channel 88 of the cyclone separators 62, 64. The center channel 88 of each cyclonic separator 62, 64 thus acts as a return duct 88 centrally positioned in the cyclonic separator 62, 64 with its upward flow direction being opposite the generally downward direction of the particle laden airstream at the outside of the cyclone separator 62, 64. Each cyclone separator 62, 64 has an air outlet 90 at the top, with an air return plenum or duct 92 returning air back from the air outlet 90 to the feed material stream from the metering unit 56. Thus, while the air stream entering the cyclone separator 62, 64 is particle-laden, substantially all the particulate matter exits the cyclone separator 62, 64 at the lower particle outlet 24, 26, and substantially all the air exits the cyclone separator 62, 64 at the upper air outlet 90.

Since the air is returned to the grinding chamber 70, it rapidly equilibrates with the moisture content of the material being ground. Since the total moisture contained in a typical sample of material to be ground (50-300 g of grain for example), far exceeds the moisture holding capacity of the air contained in the mill chambers 70, 72, cyclones 62, 64 and plenum 92 (approximately 5 liters of air), the moisture lost by the sample is virtually undetectable. The present invention thus inhibits moisture loss during milling, removing the need to measure moisture after grinding where moisture of the whole grain has already been determined e.g. by NIR, as is common at grain receival points. In particular, the grinding of the present invention provides particles at the particle separating outlet 24, 26 which have a final moisture content which has less than about a 0.4% loss from the initial moisture content.

Empirical testing validates the fact that the present invention results in a negligible moisture loss during grinding of the grain. In this testing, the present invention was compared against a prior art Cereal Mill 6000 mill available from Newport Scientific Pty Ltd. of Warriewood, NSW, Australia, with moisture content determined by AACC method 44-15A. Results are shown below in TABLE I.

TABLE I

| Mill | Sample | MC (%) | Change |
|---|---|---|---|
| No Mill | Whole Sound | 14.12 | |
| No Mill | Whole Sprouted | 13.22 | |
| No Mill | Dry | 9.72 | |
| No Mill | Medium | 11.38 | |
| No Mill | Wet | 14.46 | |
| Cereal Mill 6000 | Sound1 | 13.66 | −0.46 |
| Cereal Mill 6000 | Sound2 | 13.34 | −0.78 |
| Cereal Mill 6000 | Sound3 | 13.34 | −0.78 |
| Cereal Mill 6000 | Sound4 | 13.64 | −0.48 |
| Cereal Mill 6000 | Sprouted1 | 11.97 | −1.24 |
| Cereal Mill 6000 | Sprouted2 | 12.23 | −0.98 |
| Present Invention | Sound1 | 14.41 | 0.29 |
| Present Invention | Sound2 | 14.09 | −0.03 |
| Present Invention | Sound3 | 14.20 | 0.08 |
| Present Invention | Sound4 | 14.37 | 0.25 |
| Present Invention | Sound5 | 14.30 | 0.18 |
| Present Invention | Sprouted1 | 12.93 | −0.28 |
| Present Invention | Sprouted2 | 13.21 | −0.01 |
| Present Invention | Sprouted3 | 12.47 | −0.75 |
| Present Invention | Dry1 - Sample | 9.73 | −0.01 |
| Present Invention | Dry1 - Bulk | 9.56 | 0.16 |
| Present Invention | Dry2 - Sample | 9.85 | −0.13 |
| Present Invention | Dry2 - Bulk | 9.76 | −0.04 |
| Present Invention | Medium1 - Sample | 11.47 | −0.09 |
| Present Invention | Medium1 - Bulk | 11.34 | 0.03 |
| Present Invention | Medium2 - Sample | 11.59 | −0.22 |
| Present Invention | Medium2 - Bulk | 11.48 | −0.10 |
| Present Invention | Wet1 - Sample | 14.17 | 0.28 |
| Present Invention | Wet1 - Bulk | 14.41 | 0.05 |
| Present Invention | Wet2 - Sample | 14.39 | 0.07 |
| Present Invention | Wet2 - Bulk | 14.54 | −0.08 |

The testing data shows that for the various two samples, with original moisture contents of about 13 and 14%, the average moisture loss was about 0.8% in the older Cereal Mill 6000. In contrast, the average moisture loss or change was negligible in the present invention where the air is recycled.

Given reasonable assumptions, calculations to estimate moisture loss in the present invention have given results in line with the empirical testing, as follows:

| Prediction Of Change In Grain Moisture Content During Grinding | |
|---|---|
| Entered volume of air enclosed (liters): | 5 |
| Entered air temperature in grinding chamber 70 (° C.): | 50 |
| Entered moisture content of ground grain (% as is): | 14 |
| Entered amount of grain ground (g): | 250 |
| Entered room temperature (° C.): | 23 |
| Entered relative humidity at room temp (%): | 60 |
| Predicted change in mc (% as is): | −0.10 |

-continued

| Prediction Of Change In Grain Moisture Content During Grinding | |
|---|---|
| **Constants** | |
| Volume of 1 mole of gas at STP (liters): | 22.4 |
| Molecular weight of water: | 18 |
| Atmospheric pressure (mm Hg): | 760 |
| Equation to calculate water vapor pressure (mm Hg, T = ° C.) | |
| VP = a + b*T + c*T^2 + d*T^3 + e*T^4 | |
| a = | 4.644 |
| b = | 0.30175 |
| c = | 0.01437 |
| d = | 3.84E−05 |
| e = | 5.13E−06 |
| Equation to estimate equilibrium relative humidity from grain mc & temperature | |
| mcdry = 100 * (mc/(100 − mc)) | |
| aw = Exp(−(Exp(awb * temp + awc)) * mcdry ^(−awr)) | |
| ERH = 100*aw | |
| awr = | 2.3596 |
| awb = | −0.00547 |
| awc = | 5.6585 |
| **Working** | |
| Saturation partial pressure of water vapor in grinder (mm Hg): | 92.5 |
| Grain moisture content (dry basis, %) | 16.3 |
| ERH for grain at given mc & temp (%) | 67.3 |
| Equilibrium partial pressure of water in grinder (mm Hg): | 62.2 |
| Approximate amount of water in grinder air (g): | 0.33 |
| Saturation PP of water in air at room temp (mm Hg): | 21.1 |
| Actual PP of water in air at room temp RH (mm Hg): | 12.7 |
| Approx. amount of water in air at room temp (g): | 0.07 |
| Water gain/loss to air in grinder (g): | 0.26 |
| Final amount of water in grain after loss/gain to air (g): | 35.00 |
| Estimated grain water content before grinding (g): | 35.26 |

Notes

Calculations assume equilibrium relative humidity has been achieved, losses will be lower otherwise No correction for molar volume of gases at non-STP at this stage, will lead to slight overestimates in losses Assumes that the moisture content of the grain was measured after water was lost to/gained from air Atmospheric pressure assumed 1 bar There are a few assumptions in the equations:

a) The air in the mill 10 prior to grinding is at room temperature and humidity; This is true only on the first grind, after that the air will be warmer and will carry more water. The effect of this is will be to reduce the amount of water lost from the grain to the air during milling, which is good. That is to say, this assumption is for 'worst case'.

b) The air doesn't expand when warmed up, which is obviously not true. The effect of this is to overestimate the moles of water vapor held in the confined air, therefore again to overestimate water loss during grinding. This is only a minor effect.

c) The air will heat up to 50° C. during milling. In testing, the maximum temperatures seen were about 45° C., so this is probably an over-estimate. Since warmer air holds more water, this again will err on the high side for water loss.

d) The sorption isotherms for wheat are similar to those for barley. This part of the model predicts the relationship between grain moisture content and air relative humidity at a given temperature. The sorption isotherm model for barley is very similar to wheat because it is driven by the major components in the grain (starch and protein), which are similar. Also, the equation assumes that the air humidity reaches equilibrium with the grain moisture in the grinding time (<1 min) which it won't, so water loss will again be overestimated slightly.

The calculations are driven mainly by the temperature and volume of the air 'trapped' in the recirculating system. This defines how much water that air can hold, and therefore how much water, at most, will be taken from the grain, if the air was originally at ambient conditions.

Separate from the moisture change benefits of the present invention, since the mill 10 does not vent air to the atmosphere, there is no need to provide filters to remove potentially harmful or unpleasant dust. This reduces the cost and maintenance requirements of the mill 10. Because the unit 10 outputs essentially no dust, operators are protected from allergies and airbourne toxins and pesticides etc. that might otherwise enter the working environment.

With no locations where air readily escapes or vents during use of the unit 10, the present invention also reduces the noise output during milling. The preferred embodiment is mounted on vibration-absorbing mounts and soundproofed to reduce noise to less than 80 dB.

As exemplified in FIGS. 2 and 3, the grinding and separation unit 50 includes quick release handle lock nuts 54 which allow ready disassembly without tools. By loosening and removal of the handle nuts 54, the top plate 52 can be removed to reveal the interior of the air return plenum 92. As shown in FIG. 5, after the handle nuts 54 are removed, the intermediate wall 84 of the grinding and separation unit 50 can then be removed and turned over, giving access to the sieve 78 and the ceilings of the grinding chamber 70 and separation cyclones 62, 64. Once the intermediate wall 84 is removed, the top surface of the impeller 68 and the interiors of the separation cyclones 62, 64 are exposed for cleaning, inspection and/or repair. The unit 10 can be stripped down and re-assembled within minutes without the need for any special tools. With the impeller 68 and sieve 78 which grind the feed material, the cyclonic separators 62, 64 and the return duct and plenum 92 all formed of stainless steel, aluminum or urethane, all the materials used are suitable for sanitary contact with food.

While disassembly makes cleaning possible and easy, the recirculation of air and impeller design in the present invention makes the mill 10 essentially self-cleaning. With no dust vented to atmosphere, substantially less dust build-up occurs, minimizing the issues of contamination and carryover even if the unit 10 is not cleaned between uses. The minimal cleaning needed together with the ease of cleaning when performed significantly reduces the amount of operator time spent on cleaning during the life of the unit 10.

Although the present invention has been described with reference to preferred embodiments, workers skilled in the art will recognize that changes may be made in form and detail without departing from the spirit and scope of the invention.

The invention claimed is:

1. A grinding mill comprising:

a grinder for reducing feed material into particles, the particles being carried in an air stream, the grinder producing feed material dust in the air stream as well as particles in the air stream which are larger than the feed material dust;

two separators each receiving a portion of the particle laden air stream, in each of which the larger particles are separated from the air stream, each separator having a larger-particle separation outlet and an air stream outlet, with the larger particles exiting the separator through the larger-particle separation outlet while the air stream exits the separator through the air stream outlet; and a return duct for each separator connecting the air stream outlet from the separator back to the grinder.

2. The grinding mill of claim 1, wherein portions of the particle laden air stream from the grinder pass through two exits, the two exits including a larger exit having different dimensions from a smaller exit, with one of the separators receiving a larger portion of the particle laden air stream through the larger exit and the other separator receiving a smaller portion of the particle laden air stream through the smaller exit.

3. The grinding mill of claim 2, wherein one of the separators receives from 1 to 15% of the particle laden air stream.

4. The grinding mill of claim 1, further comprising a feed hopper for directing feed material into the grinder.

5. The grinding mill of claim 4, wherein the feed hopper has a capacity of greater than zero to about 100 liters of feed material.

6. The grinding mill of claim 1, further comprising a sieve between the grinder and at least one of the separators, with the particle laden air stream traveling through the sieve to the separator.

7. The grinding mill of claim 1, wherein at least one of the separators is a cyclonic separator, with its return duct being centrally positioned within the cyclonic separator and with return duct flow leading opposite a flow direction in the cyclonic separator.

8. The grinding mill of claim 7, wherein the cyclonic separator has its particle separation outlet at a lower end for gravity assistance during particle separation from the particle laden air stream with the particle laden air stream rotating downward, and with its return duct being centrally positioned within the cyclonic separator and with return duct flow leading upward.

9. The grinding mill of claim 1, wherein the grinding mill is for grinding food materials, and wherein the grinder, the separators and the return ducts are formed of materials suitable for sanitary contact with food.

10. The grinding mill of claim 9, wherein the grinder, separators and return ducts are all removably supported in a housing, such that all surfaces on the grinder, separators and return ducts are accessible after removal from the housing for sanitary cleaning.

11. The grinding mill of claim 10, comprising at least one hand loosenable fastener attaching one or more of the grinder, separator and return duct to the housing, such that the grinder, separator and return duct are removable from the housing without tools.

12. The grinding mill of claim 1, further comprising at least one gasket, such that the grinder, separators and return ducts are generally air tight relative to the particle separation outlet.

13. The grinding mill of claim 1, wherein air stream pressure at least one of the particle separation outlets is ambient.

14. The grinding mill of claim 1, further comprising a collection vessel sealed to one of the particle separation outlets for receiving ground material in a generally air tight manner.

15. A sampling grinding mill comprising:

a grinder for reducing feed material into particles, the particles being carried in an air stream, the grinder producing feed material dust in the air stream, wherein the particle laden air stream is divided into at least two particle laden air steams including at least a larger of the two particle laden air streams and a smaller of the two particle laden air streams; and a separator receiving only the smaller of the two particle laden air streams for withdrawing particles from the smaller of the two particle laden air streams in a representative sampling container.

16. The grinding mill of claim 15, wherein the particle laden air stream exits from the grinder through at least two exits, the two exits including a larger exit having different dimensions from a smaller exit, with the larger of the two particle laden air streams passing through the larger exit and with the smaller of the two particle laden air streams passing through the smaller exit, wherein the smaller of the two particle laden air streams is about 1 to 20% of the larger of the two particle laden air streams.

17. The grinding mill of claim 15, further comprising a feed hopper for providing feed material to the grinder, wherein the feed hopper has a capacity of greater than zero to about 100 liters of feed material.

18. The grinding mill of claim 6, wherein the grinder comprises a rotary impeller generating the air stream and projecting feed material in the air stream against the sieve.

* * * * *